United States Patent [19]

Warnke et al.

[11] 4,046,646

[45] Sept. 6, 1977

[54] METHOD OF GALVANIZING STEEL PARTS

[75] Inventors: Heinrich Warnke, Mariehfeld; Friedel Kaup, Gutersloh, both of Germany

[73] Assignee: Miele & Cie, Gutersloh, Germany

[21] Appl. No.: 636,456

[22] Filed: Dec. 1, 1975

Related U.S. Application Data

[63] Continuation-in-part of Ser. No. 502,415, Sept. 3, 1974, abandoned.

[30] Foreign Application Priority Data

Sept. 4, 1973 Germany ..... 2344434

[51] Int. Cl.[2] ..... C25D 5/36

[52] U.S. Cl. ..... 204/38 B; 427/436

[58] Field of Search ..... 204/38 B, 40, 41; 427/406, 436, 437; 29/196, 196.3, 196.4, 196.6

[56] References Cited

U.S. PATENT DOCUMENTS

| | | | |
|---|---|---|---|
| 1,096,636 | 5/1914 | McIlroy | 204/40 X |
| 2,378,458 | 6/1945 | Avallone | 427/406 X |
| 2,392,456 | 1/1946 | Brown et al. | 204/40 X |
| 2,776,255 | 1/1957 | Hammond et al. | 204/40 |
| 3,206,324 | 9/1965 | Daesen | 427/406 X |
| 3,597,261 | 8/1971 | Coburn et al. | 427/406 X |
| 3,762,883 | 10/1973 | Shepard et al. | 29/196.3 |
| 3,841,979 | 10/1974 | Arcilesi | 204/38 B |
| 3,954,420 | 5/1976 | Hyner et al. | 29/183.5 |

FOREIGN PATENT DOCUMENTS

| | | | |
|---|---|---|---|
| 28,564 | 11/1969 | Japan | 204/40 |
| 10,173 of | 1894 | United Kingdom | 204/40 |

*Primary Examiner*—G. L. Kaplan
*Attorney, Agent, or Firm*—Fleit & Jacobson

[57] ABSTRACT

A method for coating a steel part wherein the steel part is introduced into an activation bath containing metal salts such as copper and silver salts which are nobler in potential than iron to deposit a layer of the nobler metal on the surface of the steel part. The part is then immersed in a galvanizing bath in which the part is coated with zinc. Preferably, the galvanized steel part is then electrophoretically enamelled.

19 Claims, No Drawings

METHOD OF GALVANIZING STEEL PARTS

This is a continuation-in-part of Ser. No. 502,415, filed Sept. 3, 1974 now abandoned.

The invention relates to a method of galvanizing steel parts, particularly for subsequent electrophoretic enamelling.

It is important that the steel parts be coated with a uniform thin layer of zinc to improve the adhesion of enamel to the parts during the subsequent electrophoretic enamelling and to avoid as much as possible the formation of gas in the electrophoretic coating process.

A disadvantage of known galvanizing processes is that the zinc layer which is deposited on the steel parts does not have a uniform thickness. This is especially true with shaped parts wherein the zinc coating is thicker on projecting edges and corners than on the flat surfaces of the profiled part. This is believed to result from a higher electric field which is developed at the edges and corners than on the flat surfaces of the part when an electrical voltage is applied to the galvanizing bath in which the steel part is immersed. This means that in zinc-coating of relatively complicated geometric bodies, the production of a uniform thickness zinc layer over the whole body is not possible. Consequently, the electrophoretic enamelling process does not result in a uniform coating of enamel.

An object of the invention is to overcome the disadvantages of the known galvanizing processes and to provide a method of galvanizing steel parts wherein the galvanizing process produces a thin, relatively uniform coating of zinc on the steel parts.

A further object of the invention is to provide a method of galvanizing steel parts so that the parts can be electrophoretically enamelled to produce a thin relatively uniform coating of enamel.

Briefly, the essential feature of the invention is the production of a uniform coating of a nobler metal than iron on a steel part by contacting the steel part with an activation solution containing metal salts which are nobler in potential than iron to form a layer of the nobler metal on the surface of the steel part prior to galvanizing the steel part.

The steel part is preferably first cleaned by treatment with one or more cleaning agents to provide the part with a clean surface which is free of surface oxides. Various cleaning agents and baths are known in the art for efficiently degreasing and/or cleaning steel parts and any of the conventional cleaning agents or baths can be employed. Merely by way of illustration, the steel part can be cleaned with alkaline cleaning agents.

After cleaning, the steel part is immersed in an activation solution or bath. The activation solution contains metal salts which are nobler in potential than iron. The preferred nobler metals are copper, silver, palladium, tin, and cobalt. Examples of nobler metal salts which can be employed include sulfates, chlorides and the like.

The amount of metal salt present in the activation solution of the invention can vary over relatively wide ranges. However, the amount of the metal salt will normally range from about 0.1 to 25 grams per liter of activation solution. Preferably, the activation solution should contain from about 0.5 to 4.0 grams per liter of copper salt, from about 0.1 to 0.5 grams per liter of silver salt, from about 0.1 to 0.5 grams per liter of palladium salt, from about 5.0 to 20 grams per liter of tin salt, or from about 5 to 25 per liter of cobalt salt.

The activation solution or bath is typically a mineral acid bath such as hydrochloric acid or sulphuric acid bath, although organic acid baths such as acetic acid baths can also be employed. Typical activation solutions for specific nobler metals are as follows: Copper (4 g/l $CuSo_4.5H_2O$ and 50 g/l HC1); silver 0.3 g/l $Ag_2.SO_4$ and 2 to 20 g/l $H_2SO_4$); palladium 0.3 g/l $PdCl_2$ and 0.2 to 2 g/l HC1); tin (10 g/l $SnCl_2$ and 20 g/l HC1); and cobalt (25 g/l $CoSO_4.6H_2O$, 21 g/l $NaH_2PO_2.H_2O$ and 7 m1/1 98% $CH_3.COOH$).

The temperature of treatment of the steel parts in the above noted activation solution can range from as low as about 18° C up to about 90° C, and preferably is maintained between about 18° and 25° C. The time of treatment of the steel parts in the activation solution can range from as little as about 10 seconds up to about 1 minute or more, depending upon the specific composition of the activation solution and the temperature thereof. The pH of the activation solution can range from about 0.3 to 6.0 and preferably is maintained in the range of about 0.3 to about 1.0.

The conditions in the activation solution should be suitably adjusted so that the nobler metal coating has a thickness of no more than 0.1 grams per square meter of surface area.

After treatment in the activation solution, the steel part is removed from the bath and rinsed. A highly adherent nobler metal coating is thus bonded to the steel substrate. This nobler metal coating on the surface of the steel part is a uniform thin coating which is not completely closed.

The steel part having the nobler metal coating is then contacted, as by immersion of the part, in a conventional galvanizing bath, e.g., containing a zinc salt, typically zinc chloride. A typical galvanizing bath for zinc coating comprises the following composition and conditions: Zinc chloride (90 to 100 g/l); ammonium chloride (190 to 210 g/l); organic additives such as wetting agents, typically nonalkyl phenol poly glycol ether iononogenic/(30 to 40 g/l); pH (4.5 to 5.5); temperature (18° to 30° C); time (10 to 60 seconds); and current (1.0 to 3.5 amps/$dm^2$). As is conventional in the art, the zinc coating will typically have a thickness of 0.1 to 2.5 grams per square meter, preferably 0.5 to 1.0 grams per square meter.

During this galvanizing process, the zinc is distributed in a more regular thickness because the surface is more active from the electrochemical point of view due to the presence of nobler metal. For example, on shielded inner surfaces of profiled parts which can only be reached with difficulty by the electric current, a zinc coating is produced without the coat of zinc being too thick on the projecting edges and corners of the parts. In particular, thin zinc coatings of relatively regular thickness can therefore be produced with this method.

The steel part having a thin uniform zinc coating over the initially applied nobler metal coating is then rinsed, and preferably electrophoretically enamelled by conventional techniques which are well known in the art. Alternatively, the enamel coating can be applied as set forth in our copending application Ser. No. 393,823, filed Sept. 4, 1973, now U.S. Pat. No. 3,935,008, the disclosure of which is expressly incorporated herein by reference.

We claim:

1. A method for coating a steel part comprising introducing the steel part into an activation solution which contains a metal salt which is nobler in potential than iron to non-electrolytically deposit a layer of the nobler metal on the surface of the steel part and subsequently immersing the thus-coated steel part in a galvanizing bath containing a zinc salt whereupon a similar layer of zinc is electrogalvanized onto the steel part.

2. The method of claim 1 in which said nobler metal is selected from the group consisting of copper, silver, palladium, tin and cobalt.

3. The method of claim 1 in which said activation solution contains from 0.1 to 25 grams per liter of said metal salt.

4. The method of claim 1 in which said metal salt is a copper salt and said activation solution contains from 0.5 to 4.0 grams per liter of said copper salt.

5. The method of claim 1 in which said metal salt is a silver salt and said activation solution contains from 0.1 to 0.5 grams per liter of said silver salt.

6. The method of claim 1 in which said metal salt is a palladium salt and said activation solution contains from 0.1 to 0.5 grams per liter of said palladium salt.

7. The method of claim 1 in which said metal salt is a tin salt and said activation solution contains from 5.0 to 20 grams per liter of said tin salt.

8. The method of claim 1 in which said metal salt is a cobalt salt and said activation solution contains from 5.0 to 25 grams per liter of said cobalt salt.

9. The method of claim 1 in which said nobler metal layer has a thickness of up to 0.1 grams per square meter.

10. The method of claim 1 in which said zinc layer has a thickness of 0.1 to 2.0 grams per square meter.

11. A method for coating a steel part comprising immersing the steel part into an activation solution comprising an acid bath at a pH ranging from about 0.3 to 6.0 and containing a metal salt which is nobler in potential than iron, heating the activation solution containing the thus-immersed steel part at a temperature of about from 18° C to 90° C for at least about 10 seconds whereupon a layer of the nobler metal is non-electrolytically coated on the surface of the steel part, and then immersing the thuscoated steel part in a galvanizing bath containing a zinc salt whereupon a similar coating of zinc is electrogalvanized onto the steel part.

12. The method of claim 11 in which the acid is a mineral acid.

13. The method of claim 12 in which the mineral acid is hydrochloric acid.

14. The method of claim 12 in which the mineral acid is sulphuric acid.

15. The method of claim 11 in which the acid is an organic acid.

16. The method of claim 15 in which the organic acid is acetic acid.

17. The method of claim 11 in which the pH ranges from about 0.3 to 1.0.

18. The method of claim 11 in which the temperature ranges from about 18° C to 25° C.

19. The method of claim 11 which the time of treatment ranges from 10 seconds to 60 seconds.

* * * * *